United States Patent [19]

Ozawa et al.

[11] Patent Number: 4,557,058

[45] Date of Patent: Dec. 10, 1985

[54] DRUM TYPE LAUNDRY DRYER

[75] Inventors: Toru Ozawa; Hiroshi Kinoshita, both of Hitachi, Japan

[73] Assignee: Hitachi, Ltd., Tokyo, Japan

[21] Appl. No.: 612,808

[22] Filed: May 22, 1984

[30] Foreign Application Priority Data

May 23, 1983 [JP] Japan ..... 58-89142

[51] Int. Cl.[4] ..... F26B 11/04

[52] U.S. Cl. ..... 34/82; 34/133

[58] Field of Search ..... 34/82, 133; 432/105

[56] References Cited

U.S. PATENT DOCUMENTS 3,060,593 10/1962 Flora et al. ..... 34/82

4,123,851 11/1978 Itoh et al. ..... 34/82

*Primary Examiner*—Larry I. Schwartz

*Attorney, Agent, or Firm*—Antonelli, Terry & Wands

[57] ABSTRACT

A drum type laundry dryer has an outer frame, a drying drum rotatably supported by the outer frame and adapted to receive laundry to be dried, a fan for introducing air into the drying drum, a heater for heating air to be introduced into the drying drum, air outlet ports in the drying drum and a filter device adjacent to the air outlet ports. The filter device is formed by a net and a lint collector disposed in opposite relationship to the net. The lint collector is annular and spaced from the net a distance which is smaller in the inlet section of the lint collector than in an inner section thereof.

8 Claims, 16 Drawing Figures

DRUM TYPE LAUNDRY DRYER

BACKGROUND OF THE INVENTION

1. FIELD OF THE INVENTION

The present invention relates to a drum type laundry dryer, and, more particularly, to a drum type laundry dryer having an improved lint collecting unit.

2. DESCRIPTION OF THE PRIOR ART

In this type of laundry dryer, it has been known that, as a filter for collecting lint contained in air discharged from a drying drum, a lint receiver is provided around the outer periphery of the filter, as disclosed in, for example, Japanese Utility Model Publication 33886/72. However, the lint receiver fails to provide a high lint collecting efficiency.

SUMMARY OF THE INVENTION

It has been found that by providing a filter portion at a discharge port of the drying drum so that laundry to be dried moving around together with the rotation of the drying drum is brought into direct contact with the filter, the lint stuck to the filter portion is removed by the laundry to be dried.

An object of the present invention is to provide an improved drum type laundry dryer wherein such a lint removal phenomenon is utilized and, subsequently to the lint removal phenomenon, the lint is collected in the filter portion and, furthermore, the collected lint is forced into a predetermined portion, whereby clogging of the filter portion is prevented and the lint is collected in a compressed condition to thereby assure that dried clothes are almost free from lint.

The present invention is characterized in that, lint collecting means provided adjacent to said air outlet comprise filter means for capturing lint separated from the laundry to be dried in a drying drum, means disposed in opposite relationship to the filter means for establishing different filter areas on the filter means and a lint collector for receiving lint captured by the filter means and that the establishing means is operative to assure that, during operation of the laundry dryer, the filter means has a net-like contact filter area which is disposed adjacent to at least a part of the inner periphery of the filter means and is adapted to be contacted by the laundry being dried, a net-like non-contact filter area which is disposed adjacent to the outer periphery of the filter means and is adapted not to be contacted by the laundry being dried, and a netlike intermediate filter area which is disposed between the contact and non-contact filter areas and is adapted to be contacted by wet laundry being dried but not contacted by the laundry when the laundry has been substantially dried in the drying drum.

The invention will be described by way of example with reference to the accomapnying drawings.

BRIEF DESCRIPTION OF THE DRAWINGS

FIGS. 7A-1 to 7D are partial cross-sectional views of the lint collector illustrating respective steps of lint collection.

DETAILED DESCRIPTION OF THE PREFERRED EMBODIMENTS

Figure 1:
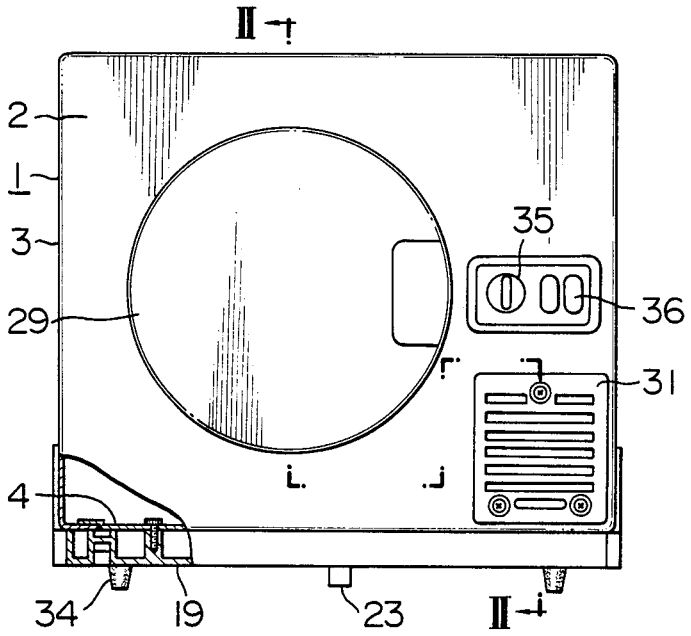
FIG. 1 is a front elevational view of a drum type laundry dryer embodying the present invention.
Figure 2:
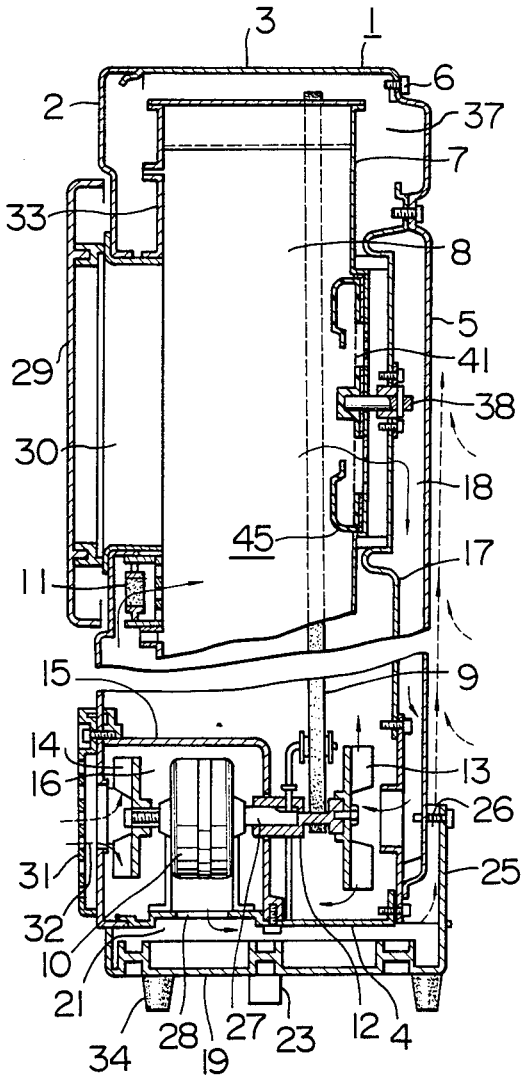
FIG. 2 is a cross-sectional view taken along the line II—II in FIG. 1.

Referring to FIGS. 1 and 2, an outer frame 1 is comprised of an outer frame front panel 2, an outer frame side panel 3 and an outer frame bottom panel 4 which are fixedly secured together by spot welding or the like. A rear cover 5 is mounted on a back face of the outer frame 1 by fastening means such as screws 6.

A drying drum 7 which defines therein a laundry drying chamber 8 is rotatably supported within the outer frame 1. The drying drum 7 is rotated by a motor 10 through a belt 9.

A heater 11 for heating air to be fed into the drying drum 7 is provided in front of the drying drum 7. A drive pulley 12 is mounted on a rotary shaft 27 of the motor 10. The belt 9 extends around the drive pulley 12 and the drying drum 7.

An air circulating fan 13 and a cooling air fan 14 are mounted on the opposed ends of the motor 10, respectively.

A motor receiving chamber 16 for receiving therein the motor 10 and the cooling air fan 14 is defined by a partitioning wall member 15.

A supporting member 17 for rotatably supporting, together with a shaft 38, a rear portion of the drying drum 7 through felts cooperates with the rear cover 5 to define a circulation duct 18.

A box-shaped water reservoir 19 provided under the outer frame 1 serves to receive water produced in the outer frame 1 and flowing downwardly therefrom. The water reservoir 19 cooperates with the outer frame bottom panel 4 to define a cooling duct 21. A drain 23 serves to discharge therethrough the water collected in the water reservoir 19.

A cooling air guide member 25 is provided such that a cooling air outlet 26 is formed between the guide member 25 and the rear cover 5. The cooling duct 21 is communicated with the motor receiving chamber 16 through a communication port 28 formed in the outer frame bottom panel 4.

A door 29 is supported by the front face of the outer frame 1 and adapted to open and close a cloth throwing opening 30 of the drying drum 7. A fan protector 31 is provided in front of a cooling air inlet 32.

The above-described heater 11 is mounted on a second supporting member 33 for rotatably supporting a front portion of the drying drum 7 through felts. Leg members 34 are integrally connected to the water reservoir 19.

A timer 35 and a change-over switch 36 are mounted together on the front face of the outer frame 1.

Figure 3:
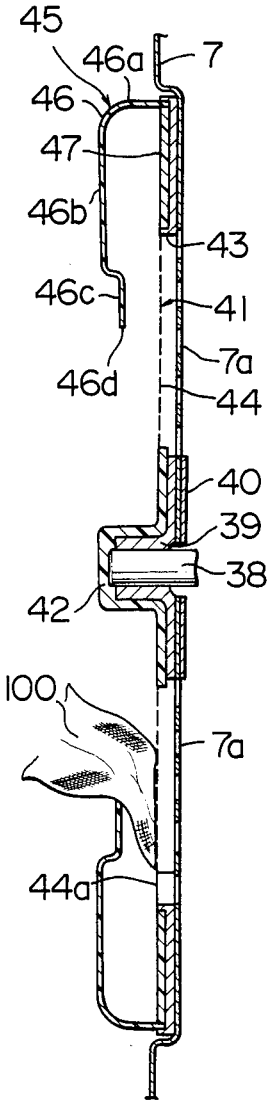
FIG. 3 is an enlarged cross-sectional view of a lint collecting unit and its associated parts.

A lint collecting unit will now be described. As shown in FIG. 3, the shaft 38 is fixed to the center of the rear wall of the drying drum 7 by shaft fastening members 39 and 40. The rear wall of the drying drum 7 is outwardly depressed to form a relatively large circular recess in the wall which has an annular circumference about the shaft 38. In the bottom face of the recess, there are formed a number of air outlet ports *7a*.

An annular filter device 41 has a filter portion which is formed by providing an annular net 44 between a boss 42 and an outer circumferential ring 43. The net 44 is made of polyester and is of 100 to 350 meshes. The net 44 is attached by melt-bonding between the inner periphery of the boss 42 and the outer periphery of the outer circumferential ring 43, the boss 42 and the ring 43 being made of a synthetic resin.

The filter device 41 is mounted on the drying drum 7 by mounting the boss 42 over the shaft 38 and the shaft fastening member 39 and fastening the outer circumferential ring 43 to the drying drum 7 by means of screws or the like.

Since all the air outlet ports *7a* are covered by the filter device 41 located inside the drying drum 7, lint such as waste threads and fine fibers separated from washed clothes to be dried are trapped or collected by the filter device 41 and prevented from being discharged out of the drum through the air outlet ports *7a*.

On the front side of the filter device 41, there is provided an annular lint collector 45 which is detachably mounted on the inside of the drying drum 7. The lint collector 45 is formed by an annular front portion 46 and an annular rear portion 47.

The front portion 46 is composed of a cylindrical outer peripheral wall section **46*a* and an integral annular front wall section 46*b* which has a step offset portion 46*c* offset toward the filter 41. The offset portion has a circular peripheral edge defining circular opening 46*d***.

The diameter of the opening **46*d* is smaller than the outer diameter of the net 44 and is selected such that, when wet clothes 100 moving around within the drying drum 7 intrude into a gap defined between the net 44 and the front portion 46*b*, there is left with the net 44 a non-contact net surface area 44*a* which is never contacted by the clothes to be dried and which is located in the vicinity of the outer peripheral edge of the net 44**.

The rear portion 47 of the dust collector has an outer peripheral portion inserted into the outer peripheral wall section **46*a* of the front portion 46 and is detachably mounted on the front portion 46 to complete the dust collector 45**.

The dust collector 45 is detachably mounted on the inside of the drying drum 7 by inserting the outer peripheral wall section **46*a* of the front portion 46 into the outer circumferential ring 43 of the filter device 41**.

With respect to dimension of the filter device 41, the outer diameter of the net 44 is 180 mm, whereas with respect to the lint collector 45, the outer diameter of the outer peripheral wall section **46*a* of the front portion 46 is 240 mm, the offset portion 46*c* has a width of 15 mm and an offset of from 5 to 10 mm and the outer diameter of the opening 46*d* is 124 mm. The distance between the net 44 of the filter device 41 and the front wall 46*b* of the front section 46 of the dust collector 45** is selected to be in the range of from 8 mm to 14 mm as measured at the offset portion.

The front portion 46 and the rear portion 47 are made of a synthetic resin.

In operation, the air which has absorbed moisture from the materials to be dried, i.e., the clothes in the laundry drying chamber 8 of the drying drum 7, and which is at a high humidity and still at a high temperature is sucked by the fan circulating air 13 and introduced into the circulation duct 18. After the air is cooled and dehydrated in the circulation duct 18, the air flows through the air circulating fan 13 into the space 37 defined between the drying drum 7 and the outer frame 1. The air is further cooled in the space 37 and is further dehydrated therein. Thereafter, the air is heated by the heater 11 and introduced again into the drum 7 to absorb the moisutre containing in the clothes therein. The operation is repeated to proceed with the drying of washed clothes.

Figure 4:
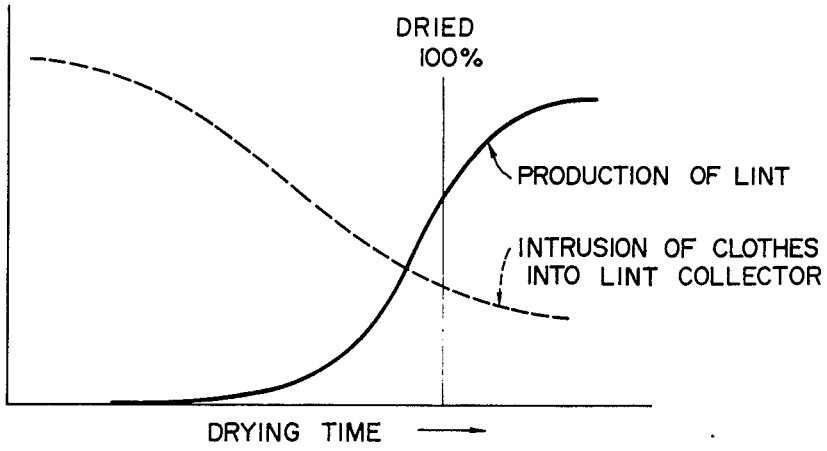
FIG. 4 is a graph showing production of lint, such as waste threads produced in the drying operation, and intrusion of the clothes into a lint collector.

As shown by the solid line in the graph in FIG. 4, almost no lint such as waste threads from the clothes are produced in the initial stage of drying and a large amount of lint is produced at or near the final stage of drying.

Figure 5:
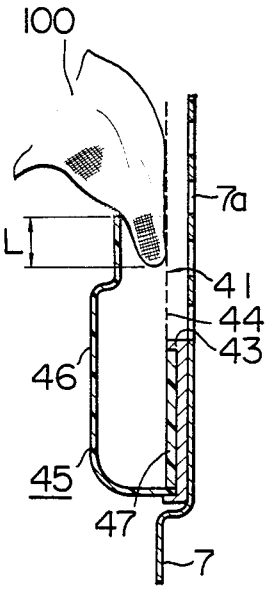
FIG. 5 is a fragmentary cross-sectional view of the lint collector showing the intrusion of the clothes into the lint collector.

Intrusion of the clothes to be dried moving around within the drying drum 7, into the lint collector 45, as indicated by L in FIG. 5, is maximum when the clothes 100 to be dried are wet at the initial stage of drying and is minimum when the clothes 100 to be dried have been dried at the final stage of drying, as indicated by the dotted line in the graph shown in FIG. 4.

Figure 6A:
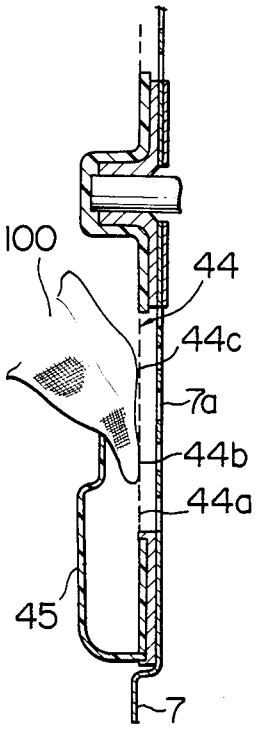
FIGS. 6A and 6B are fragmentary cross-sectional views of the lint collector showing the intrusions of the wet and dry clothes into the lint collector, respectively.
Figure 6B:
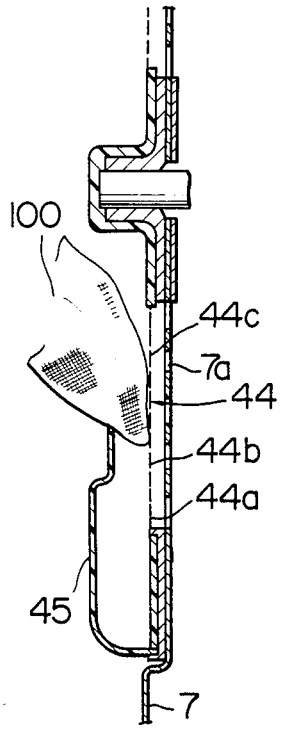

Due to the difference in the intrusion of the clothes 100 to be dried into the lint collector 45, the net 44 of the filter device is, as shown in FIGS. 6A and 6B, caused to have three areas, an inner contacting net area **44*c* with which the clothes 100 to be dried are brought into contact during operation of the dryer, an outer noncontact net area 44*a* which is not contacted by the clothes 100 to be dried during the operation and an intermediate contacting net area 44*b* which is located between the contacting net area 44*c* and the non-contact net area 44*a*. In the intermediate contact net area 44*b*, the clothes are brought into contact with the net when the clothes 100 to be dried are in wet condition but, the clothes 100** do not contact with the net when the clothes have been dried.

In this case, this is because the offset portion **46*c* of the dust collector 45 is provided in opposite relationship to the filter device 41** and serves as means for establishing different filter areas.

FIG. 6A illustrates a state in which wet clothes are in contact with the intermediate net area **44*b* while FIG. 6B shows a state in which dried clothes are not in contact with the intermediate net area 44*b***.

The lint such as waste threads separated during drying from the material or clothes to be dried are entrained by the flow of circulated drying air to be discharged through the air outlet ports *7a* of the drying drum 7 and are carried by the air flow to the filter device 41 whereupon the lint is captured or collected by the net 44.

The clothes 100 to be dried are brought into contact with the contacting net area **44*c* of the net 44, so that the lint stuck to this net area 44*c* is removed therefrom. Accordingly, the lint such as waste threads is not deposited on the contacting net area 44*c* whereby this net area is kept free from clogging to assure a constant rate of air flow through the net 44**.

On the other hand, since the clothes 100 to be dried do not contact the non-contact area **44*a* of the net 44, the lint such as waste threads can be collected thereon. In the intermediate net area 44*b*, the clothes 100 will not be contacted with the net 44 in the final drying stage when a great amount of the lint is generated. Thus, the lint can be collected on the intermediate net area 44*b***.

The operation of the lint collector relative to the lapse of drying time will now be described with reference to FIGS. 7A-1 to 7D.

Figures 1, 7A:
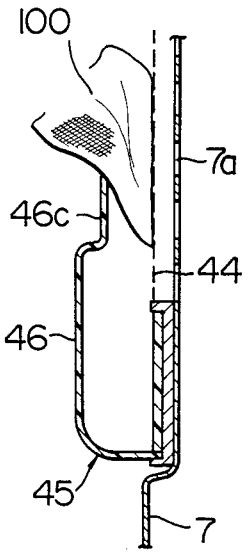
Figures 2, 7A:
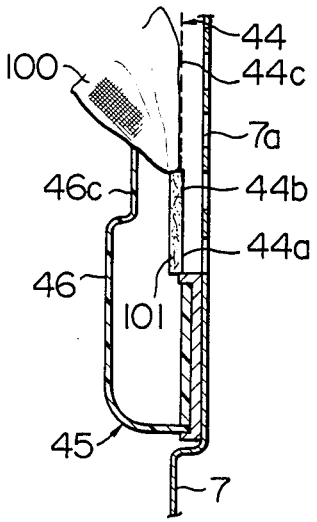

FIGS. 7A-1 and 7A-2 show a first drying operation, FIG. 7A-1 showing an initial drying stage and FIG. 7A-2 a final drying stage. Lint 101 which is produced in the first drying operation is collected on the intermediate net area 44*b* and the non-contact net area 44*a* to form a doughnutlike deposit.

Figures 1, 7B:
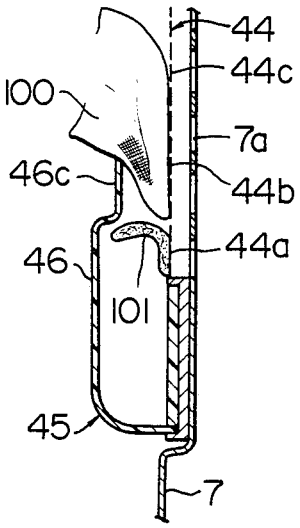
Figures 2, 7B:
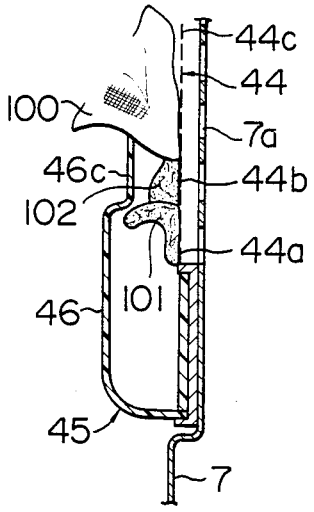

When a second drying operation is carried out, wet clothes 100 stage intrude into the inside of the lint collector 45 at the initial drying stage, as shown in FIG. 7B-1, to thereby peel apart from the intermediate net area 44*b* the deposit of the lint 101 collecting during the first drying operation and stuck to the intermediate net area 44*b*. Then, the lint is pushed radially outwardly. As a result, the intermediate net area 44*b* is cleaned.

Under this condition, the drying is continued. At the final drying stage shown in FIG. 7B-2, the lint 102 such as waste threads separated from the clothes 100 to be dried is collected on the intermediate net area 44*b* into which the clothes 100 do not intrude and thus do not contact with the net in this area 44*b*.

Figures 1, 7C:
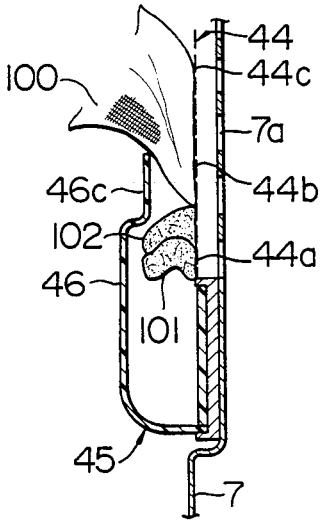
Figures 2, 7C:
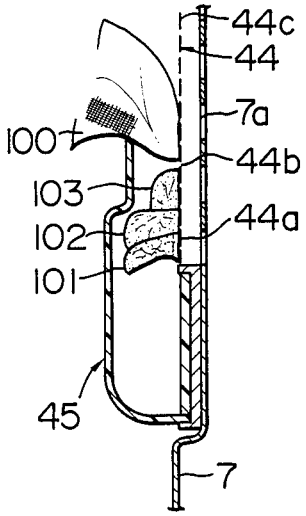
Figure 7D:
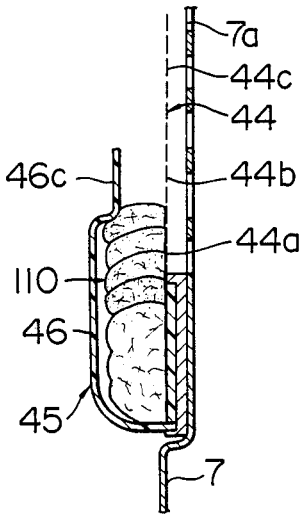

Under this condition, when a third drying operation is started, lint 103 is similarly collected throughout the third drying operation from the initial drying stage thereof shown in FIG. 7C-1 to the final drying stage shown in FIG. 7C-2.

When such operations are repeated in this manner, deposits of lint are pushed into the dust collector 45 one after another. As a result, the deposits of lint are collected in the form of a laminated mass of lint 110, as shown in FIG. 7D.

Since the offset portion 46*c* is formed in the front wall 46*b* of the front portion 46 of the lint collector 45 so that, when the lint such as waste threads stuck to the intermediate net area 44*b* is pushed radially outwardly into the dust collector 45, the lint is out of contact with the front wall 46*b*, the lint can be pushed radially outwardly by a slight force and can also be prevented from moving back, radially inwardly. Thus, a large amount of lint can be collected until the lint collector 45 is fully filled with the lint.

As described above, since an automatic lint removal is attained in the contact net area 44*c* during drying operations, there is no clogging in the contact net area 44*c*. It is, therefore, possible to assure a constant rate of air flow through the dryer.

The lint is collected on the intermediate net area 44*b* and the non-contact net area 44*a* of the net 44 and is received in the lint collector 45. Therefore, the removed lint is not mixed again with clothes to be dried. It is possible to obtain dried clothes which are almost free from lint.

When cleaning of the lint collector 45 is required, it is sufficient to pick up and waste the laminar mass 110 of lint by removing the lint collector 45 from the drying drum 7 and separating the front portion 46 and the rear portion 47 from each other. Thus, the cleaning of the lint collector 45 can readily be conducted.

The rear portion 47 is not essential and a lint collector 45 consisting only of the front portion 46 can be used substantially in the same manner provided that the filter device 41 is made detacheable from the drying drum 7 and removable together with the front portion 46 when a cleaning is conducted.

Figure 8:
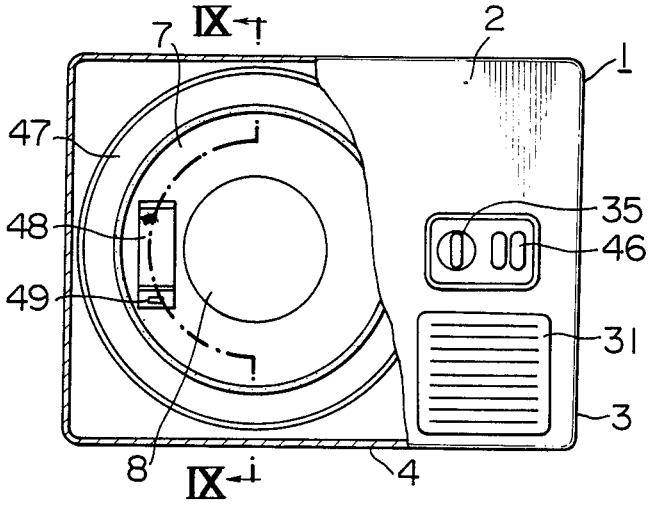
FIGS. 8 and 9 are show another embodiment of the present invention, FIG. 8 being a partially sectional front elevation of a drum type laundry dryer and FIG. 9 being a cross-sectional view taken along the line IX—IX in FIG. 8.
Figure 9:
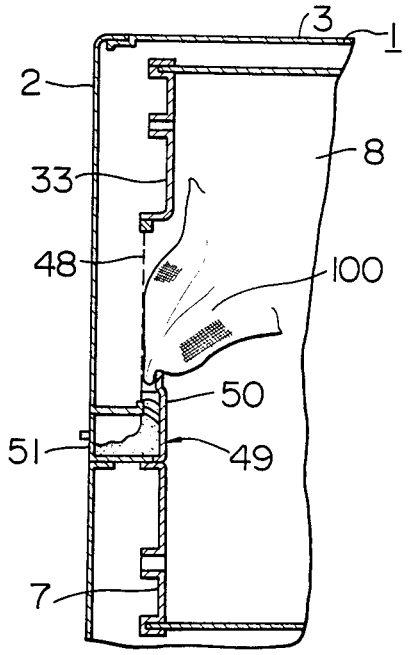

Another embodiment of the invention will now be described with reference to FIGS. 8 and 9. A cloth-drying chamber 8 is defined by a drying drum 7 and a drum front portion supporting member 33. An air outlet port is formed in the drum front portion supporting member 33. A filter 48 is provided in the air outlet port. A lint collector 49 is provided below the filter 48.

The lint collector 49 is divided into an upper portion 50 and a lower portion 51. In the same manner as in the foregoing embodiment, the net surface of the filter 48 is divided into a contact net area, an intermediate net area and a non-contact net area. The lower portion 51 is of the drawer type which may be drawn from outside.

The lint collector 49 and the filter 48 may alternatively be provided on the door for clothes.

It is not essential that the net of the filter device extends throughout the filter device. Radial or ring-like ribs that are not porous may alternatively be provided in a part of the filter device.

As described above, the lint collecting means of the laundry dryer according to the present invention comprises filter means for capturing lint separated from laundry to be dried in said drying drum, means disposed in opposite relationship to said filter means for establishing different filter areas on said filter means and a lint collector for receiving lint captured by said filter means, said establishing means being operative to assure that, during operation of said washing dryer, said filter means has a net-like contact filter area which is disposed adjacent to at least a part of the inner periphery of said filter means and is adapted to be contacted by the laundry being dried, a net-like non-contact filter area which is disposed adjacent to the outer periphery of said filter means and is adapted not to be contacted by the laundry being dried, and a net-like intermediate filter area which is disposed between said contact and non-contact filter areas and is adapted to be contacted by wet laundry being dried but not contacted by the laundry when it has been substantially dried in the drying drum. Thus, the lint adhered to the contact filter area can be peeled off away from the filter means by the laundry being dried in the drying drum and moving around therein. The filter means, therefore, can be automatically cleaned. The lint removed from the contact filter area can then be forced by the laundry into the lint collector and prevented from being moved back into the laundry moving around in the drying drum. Thus, the present invention advantageously assures that dried laundry is almost free from lint.

What is claimed is:

1. A drum type laundry dryer including an outer frame, a drying drum rotatably supported by said outer frame and adapted to receive laundry to be dried, means for introducing air into said drying drum, means for heating the air to be introduced into said drying drum, an air outlet provided in said drying drum, and lint collecting means provided adjacent to said air outlet, wherein said lint collecting means comprises filter means for capturing lint separated from laundry being dried in said drying drum, means for establishing different filter areas on said filter means and a lint collector for receiving lint captured by said filter means, said filter means including a net-like filter section including a radially inner filter area adapted to be exposed to the laundry in said drying drum, said establishing means being disposed in closely spaced, opposed relationship to the portion of said net-like filter section radially outward of said radially inner filter area and operating to assure that, during operation of the laundry dryer, said portion of said net-like filter section has a radially outer area adapted not to be contacted by the laundry being dried and an intermediate filter area disposed between said radially inner and outer filter areas and adapted to be contacted by wet laundry being dried but not contacted by the laundry when the laundry has been substantially dried in said drying drum.

2. A drum type laundry dryer according to claim 1, wherein said filter means further includes a central boss section and an outer peripheral ring section, said radially inner and outer filter areas and said intermediate filter area being disposed between said central boss and outer peripheral ring sections.

3. A drum type laundry dryer according to claim 1, wherein said establishing means is contiguous with said lint collector and disposed inwardly of said lint collector.

4. A drum type laundry dryer according to claim 3, wherein said establishing means and said lint collector are integral and are detachably connected to said filter means.

5. A drum type laundry dryer according to claim 3, wherein said establishing means and said lint collector are detachable one from the other and said lint collector is movable outwardly.

6. A drum type laundry dryer according to claim 1, wherein the distance between said filter means and said establishing means is smaller than the distance between said filter means and said lint collector.

7. A drum type laundry dryer including an outer frame, a drying drum rotatably supported by said outer frame and adapted to receive laundry to be dried, means for introducing air into said drying drum, means for heating the air to be introduced into said drying drum, an air outlet provided in said drying drum, and lint collecting means provided adjacent to said air outlet, wherein said lint collecting means comprises a filter means for capturing lint separated from laundry to be dried in said drying drum and a lint collector disposed upstream of said filter means in closely spaced, opposed relationship thereto, said filter means being adapted to be exposed to the laundry in said drying drum except for the section of said filter means covered by said lint collector, the spacing between said lint collector and said filter means being smaller in an inlet portion of said lint collector than in an inner portion thereof.

8. A drum type laundry dryer including an outer frame, a drying drum rotatably mounted in said outer frame and adapted to receive laundry to be dried, means for introducing air into said drying drum, means for heating the air to be introduced into said drying drum, an air outlet provided in said drying drum, and lint collecting means adjacent to said air outlet, wherein said lint collecting means comprises filter means for capturing lint separated from laundry being dried in said drying drum and a lint collector disposed upstream of said filter means in closely spaced, opposed relationship to part of said filter means, said filter means except for said part being exposed to the interior of said drying drum.

* * * * *